US010041686B2

(12) United States Patent
Hildner et al.

(10) Patent No.: US 10,041,686 B2
(45) Date of Patent: Aug. 7, 2018

(54) DOOR FOR A DOMESTIC APPLIANCE

(71) Applicant: Electrolux Appliances Aktiebolag, Stockholm (SE)

(72) Inventors: Dietmar Hildner, Rothenburg ob der Tauber (DE); Branko Ivanovic, Rothenburg ob der Tauber (DE); Erhardt Koitzsch, Rothenburg ob der Tauber (DE)

(73) Assignee: Electrolux Appliances Aktiebolag, Stockholm (SE)

( * ) Notice: Subject to any disclaimer, the term of this patent is extended or adjusted under 35 U.S.C. 154(b) by 191 days.

(21) Appl. No.: 14/914,563

(22) PCT Filed: Jul. 28, 2014

(86) PCT No.: PCT/EP2014/066164
§ 371 (c)(1),
(2) Date: Feb. 25, 2016

(87) PCT Pub. No.: WO2015/062756
PCT Pub. Date: May 7, 2015

(65) Prior Publication Data

US 2016/0209047 A1 Jul. 21, 2016

(30) Foreign Application Priority Data

Oct. 31, 2013 (EP) ..... 13191089

(51) Int. Cl.
*F24C 15/02* (2006.01)
*F24C 15/04* (2006.01)
(Continued)

(52) U.S. Cl.
CPC ..... *F24C 15/045* (2013.01); *F24C 15/007* (2013.01); *F24C 15/04* (2013.01); *F25D 23/02* (2013.01)

(58) Field of Classification Search
CPC ..... F24C 15/04; F25D 23/02
(Continued)

(56) References Cited

U.S. PATENT DOCUMENTS 2,535,589 A * 12/1950 Mills ..... F24C 15/04 126/200
3,731,035 A * 5/1973 Jarvis ..... H05B 6/6414 126/190
(Continued)

FOREIGN PATENT DOCUMENTS

DE 10143923 A1 3/2003
DE 10143928 A1 5/2003
(Continued)

OTHER PUBLICATIONS

Examination Report issued in corresponding European Patent Application No. 13191089.5 dated Oct. 6, 2016, 7 pages.
(Continued)

*Primary Examiner* — Gregory Huson
*Assistant Examiner* — Nikhil Mashruwala
(74) *Attorney, Agent, or Firm* — Pearne & Gordon LLP

(57) ABSTRACT

The present invention relates to a door for a domestic appliance, in particular a cooking oven. Said door comprises a door frame (14) formed as a closed rectangular frame, at least one outer glass panel (10) attached or attachable at an outer side of the door frame (14), at least one inner glass panel (16) attached or attachable at an inner side of the door frame (14), at least one outer sealing element (38) arranged or arrangeable between the inner side of the outer glass panel (10) and the outer side of the door frame (14), and at least one inner sealing element (40) arranged or arrangeable between the outer side of the inner glass panel (16) and the inner side of the door frame (14). The large area side of the outer glass panel (10) is bigger than the large area side of the
(Continued)

Figure 1:
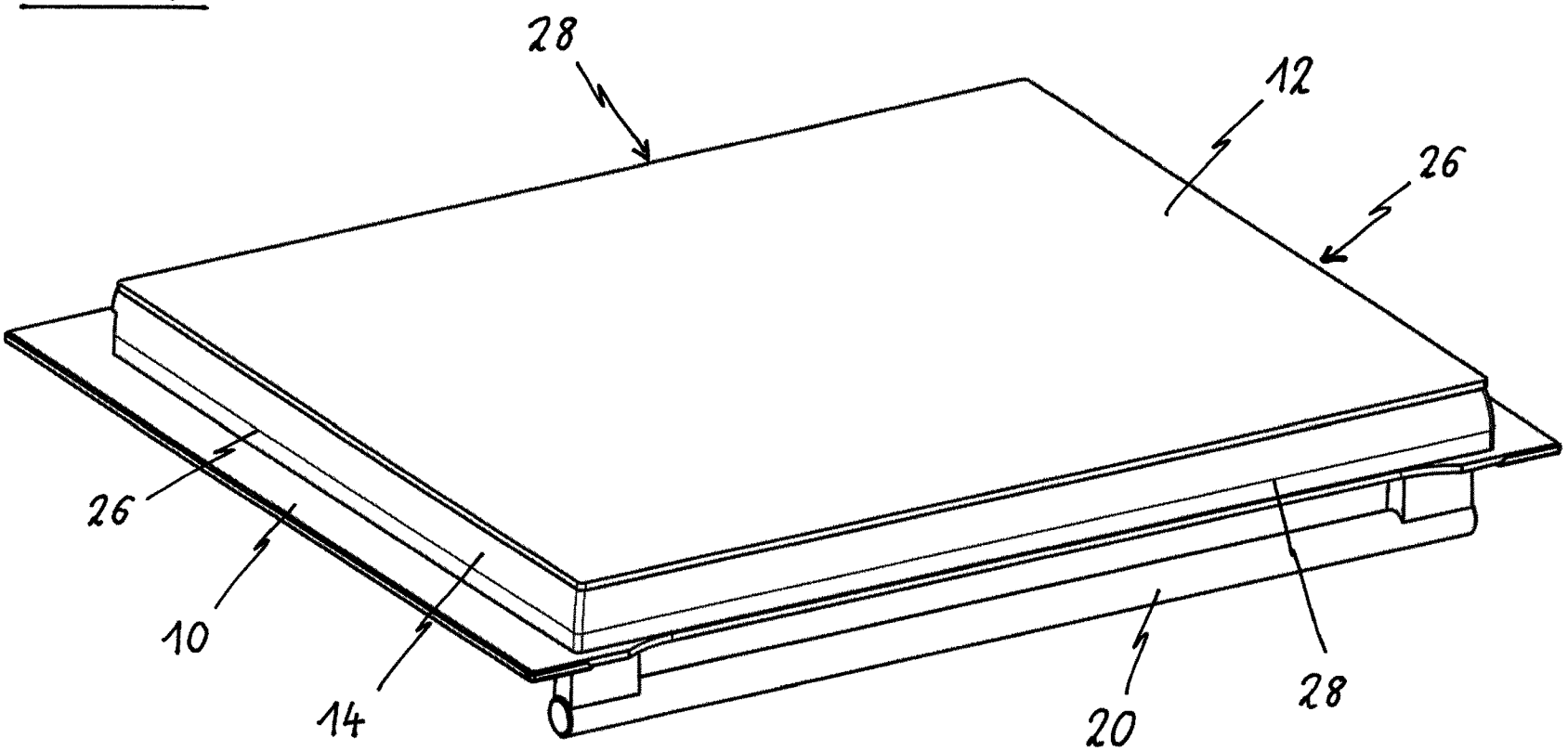

door frame (14). Further, the large area side of the outer glass panel (10) is bigger than the large area side of the inner glass panel (16). At least one inner space inside the door frame (14) and between the outer glass panel (10) and inner glass panel (16) is hermetically closed. Further, the present invention relates to a domestic appliance, in particular a cooking oven, including at least one door.

14 Claims, 5 Drawing Sheets

(51) Int. Cl.
*F24C 15/00* (2006.01)
*F25D 23/02* (2006.01)

(58) Field of Classification Search
USPC ..... 126/200, 198; 219/740, 741
See application file for complete search history.

(56) References Cited

U.S. PATENT DOCUMENTS 3,760,792 A * 9/1973 White ..... F24C 15/04 126/198
4,043,091 A * 8/1977 Katona ..... F24C 15/04 126/200
4,253,286 A * 3/1981 Katona ..... F24C 15/006 126/198
5,738,081 A * 4/1998 Puricelli ..... F24C 14/02 126/21 A
5,789,724 A * 8/1998 Lerssen ..... H05B 6/766 126/200
7,726,295 B2 * 6/2010 Elkasevic ..... F24C 15/006 126/190
7,819,113 B2 * 10/2010 Chin ..... F24C 15/04 110/112
8,975,562 B2 * 3/2015 Galbreath ..... H05B 6/766 156/106
9,115,903 B2 * 8/2015 Lim ..... F24C 15/04
9,476,187 B2 * 10/2016 Liang ..... E03C 1/0403
9,750,088 B2 * 8/2017 Hofmann ..... H05B 6/6405
9,907,122 B2 * 2/2018 Himmelein ..... H05B 6/763
2006/0027230 A1 * 2/2006 Jung ..... F24C 15/04 126/200
2007/0271847 A1 * 11/2007 Chin ..... F24C 15/04 49/70
2015/0334788 A1 * 11/2015 Hofmann ..... H05B 6/6405 219/743
2016/0045038 A1 * 2/2016 Chubb ..... A47F 3/0434 312/116
2018/0003395 A1 * 1/2018 Reinhard-Herrscher ..... F24C 15/04

FOREIGN PATENT DOCUMENTS

DE 10202144 A1 7/2003
DE 10243552 A1 4/2004
DE 102004002469 A1 8/2005
EP 2634493 A1 9/2013
GB 2410325 A 7/2005

OTHER PUBLICATIONS

International Search Report for PCT/EP2014/066164, dated Sep. 23, 2014, 3 pages.

* cited by examiner

DOOR FOR A DOMESTIC APPLIANCE

The present invention relates to a door for a domestic appliance, in particular for a cooking oven. Further, the present invention relates to a domestic appliance, in particular a cooking oven, including at least one door.

The door of a domestic appliance often has a complex structure. In particular, the door of a cooking oven includes usually a number of glass panels fixed in a mechanical structure. Said glass panels have to be cleaned. Thus, a suitable structure of the door is required. If the mechanical structure of the door is realized by a number of different components, then the assembling and disassembling of the glass panels is difficult, so that additional tools and/or components may be required. Further, the complex mechanical structure of the door may cause leakages, in particular during the heating process.

It is an object of the present invention to provide an improved door for a domestic appliance, wherein the door comprises only a small number of the components and the mechanical structure of said door has a low complexity.

This object is achieved by the door according to claim 1.

The present invention relates to a door for a domestic appliance, in particular a cooking oven, wherein said door comprises:

- a door frame formed as a closed rectangular frame,
- at least one outer glass panel attached or attachable at an outer side of the door frame,
- at least one inner glass panel attached or attachable at an inner side of the door frame,
- at least one outer sealing element arranged or arrangeable between the inner side of the outer glass panel and the outer side of the door frame, and
- at least one inner sealing element arranged or arrangeable between the outer side of the inner glass panel and the inner side of the door frame, wherein
- the large area side of the outer glass panel is bigger than the large area side of the door frame,
- the large area side of the outer glass panel is bigger than the large area side of the inner glass panel , and
- at least one inner space inside the door frame and between the outer glass panel and inner glass panel is hermetically closed.

The main idea of the present invention is the function of the closed rectangular door frame as the central component of the door. The glass panels may be attached at the both large area sides of the door frame and/or arranged inside said door frame.

In particular, the door frame is made of plastics.

Preferably, the door frame is formed as a single-piece part.

Further, the door comprises a sandwich panel including the inner glass panel and at least one further inner glass panel, wherein said inner glass panel and at least one further inner glass panel are permanently connected together.

In this case, the at least one further inner glass panel of the sandwich panel is arranged or arrangeable inside the door frame. Alternatively, the further inner glass panel is attached at the inner side of the door frame, so that the further inner glass panel is arranged between the inner glass panel and the door frame.

If the further inner glass panel of the sandwich panel is arranged or arrangeable inside the door frame, then the door frame may include at least one snap-in pin element for grasping the further inner glass panel of the sandwich panel.

Additionally, the door comprises at least one central glass panel arranged or arrangeable inside the door frame.

For the central glass panel, the door frame includes at least one support projection for supporting the outer side of the central glass panel, wherein the support projection is directed into the inner space of the door frame.

Moreover, the door frame includes at least one further snap-in pin element and at least one further support projection for supporting the inner side of the central glass panel, wherein the further snap-in pin element and the further support projection are directed into the inner space of the door frame.

In particular, the door frame includes at least one outer grove for receiving the outer sealing element and/or at least one inner grove for receiving the inner sealing element.

According to one embodiment, the outer sealing element and/or the inner sealing element is a gluing strip or are gluing strips, respectively, for example, a silicone gluing strip or silicone gluing strips, respectively.

Alternatively or additionally, the outer sealing element and/or the inner sealing element is a gasket or are gaskets, respectively.

Further, at least one of the glass panels is moulded at the door frame.

Preferably, the door frame includes two side parts and at least two transversal parts, wherein each side part comprises at its lower end a recess for receiving a hinge element of a door hinge.

Furthermore, the door frame may include at least one screw support projection with at least one hole for receiving a screw, wherein said screw support projection is directed into the inner space of the door frame, and wherein the at least one screw is provided for fixing a door handle. For example, the screw support projection is formed as a rectangular sheet. Preferably, the screw support projection is aligned at the inner side of the outer glass panel.

At last, the present invention relates to a domestic appliance, in particular a cooking oven, wherein the domestic appliance comprises the door mentioned above.

Novel and inventive features of the present invention are set forth in the appended claims.

Figure 2:
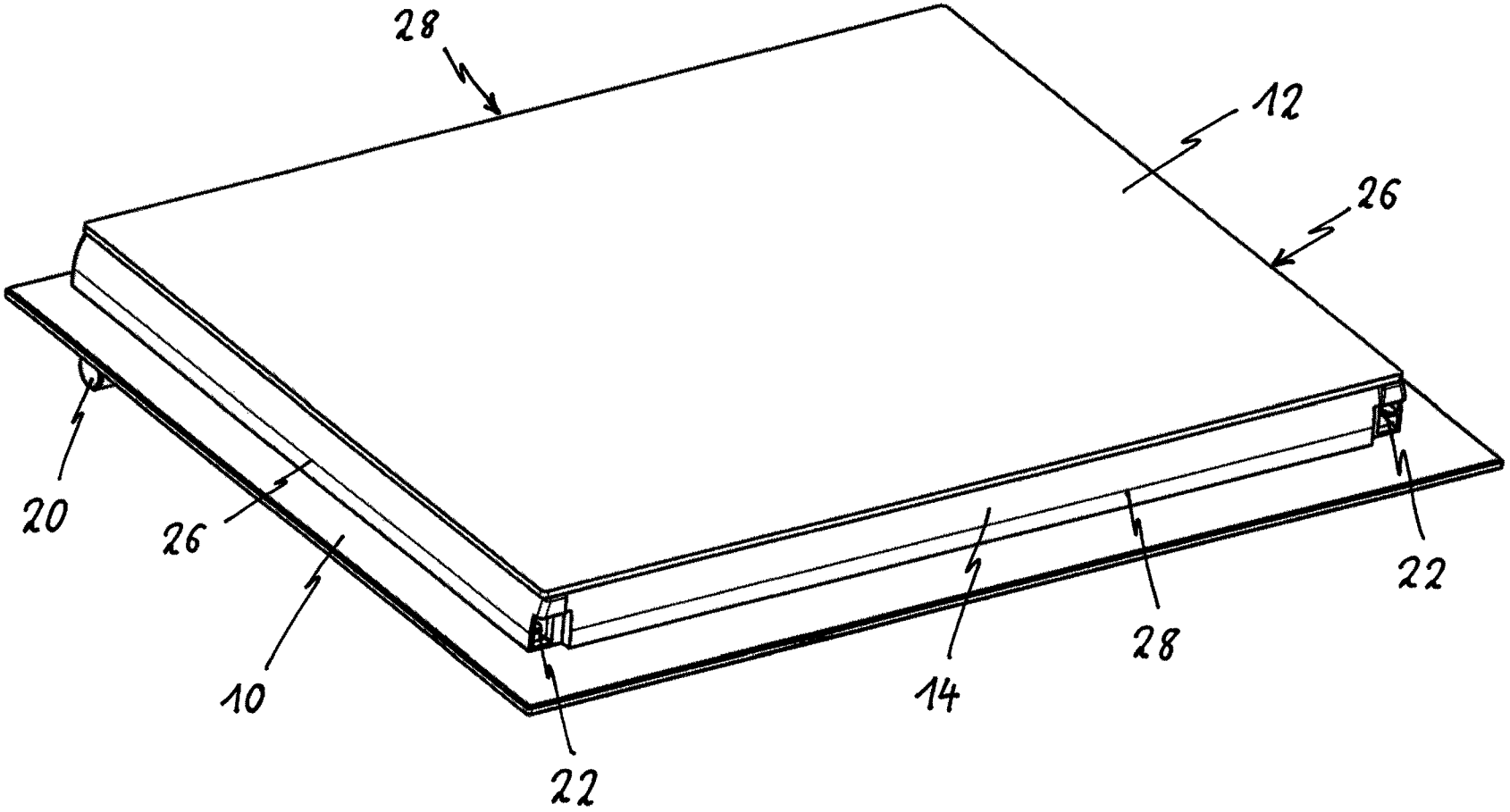
Figure 3:
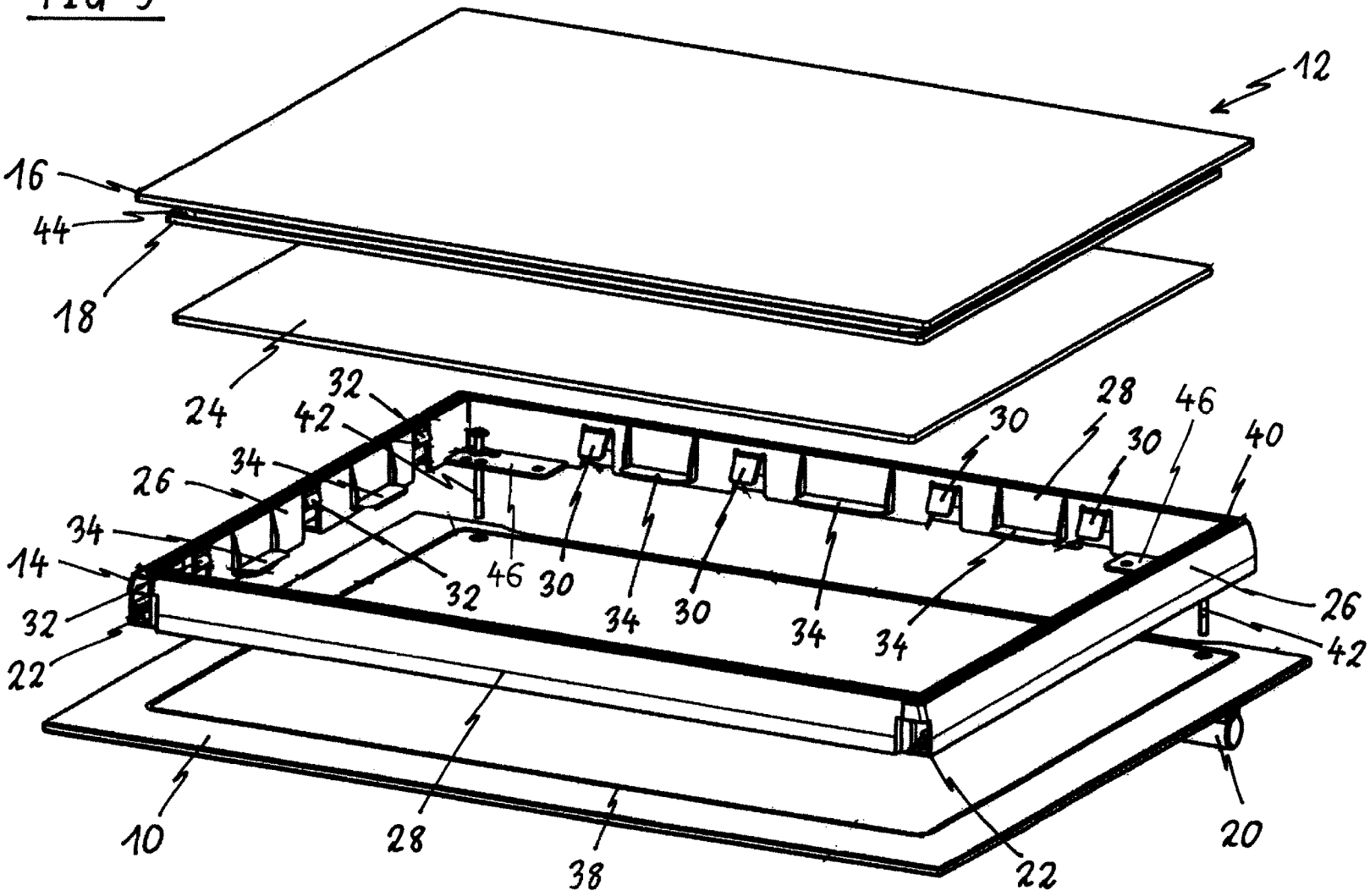
Figure 4:
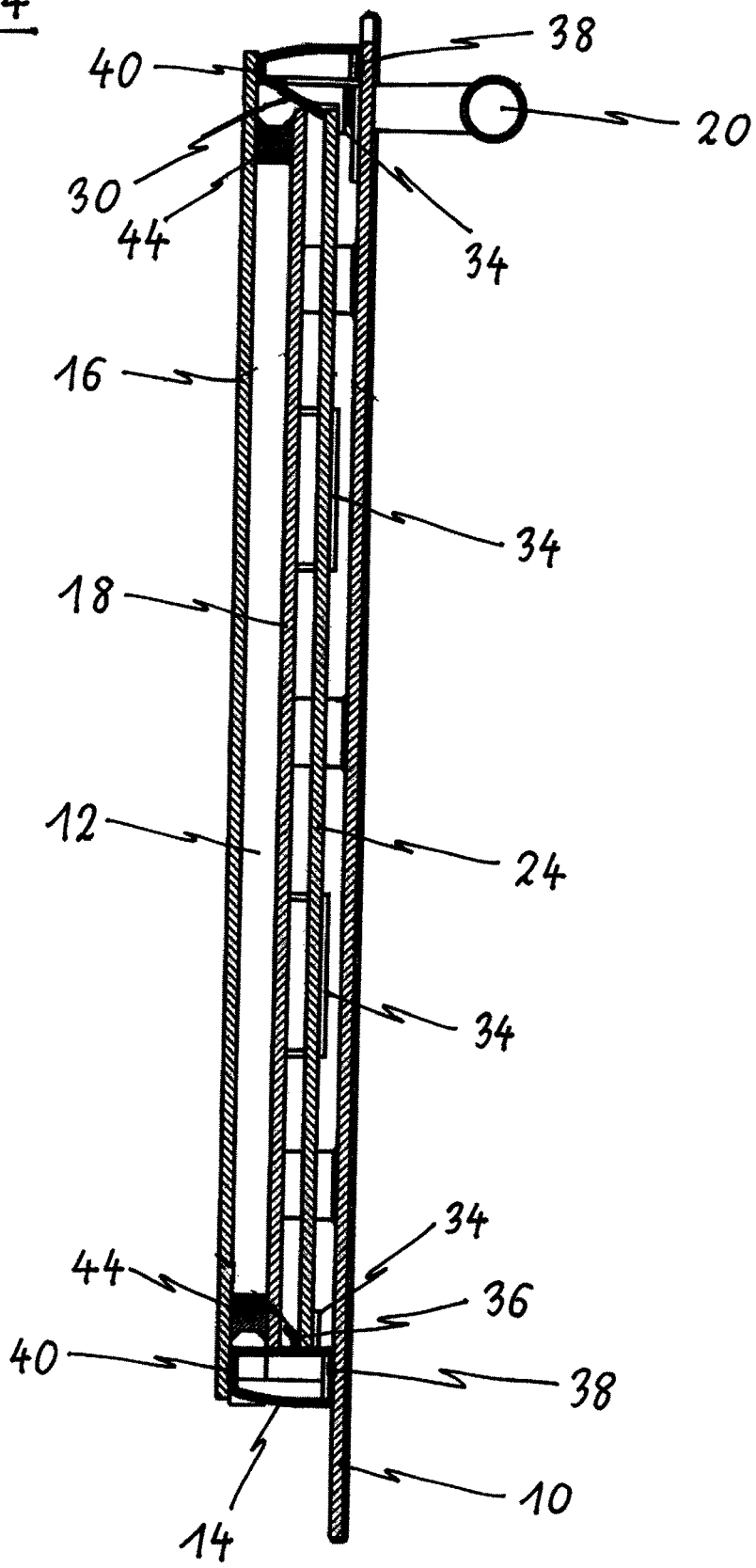
Figure 5:
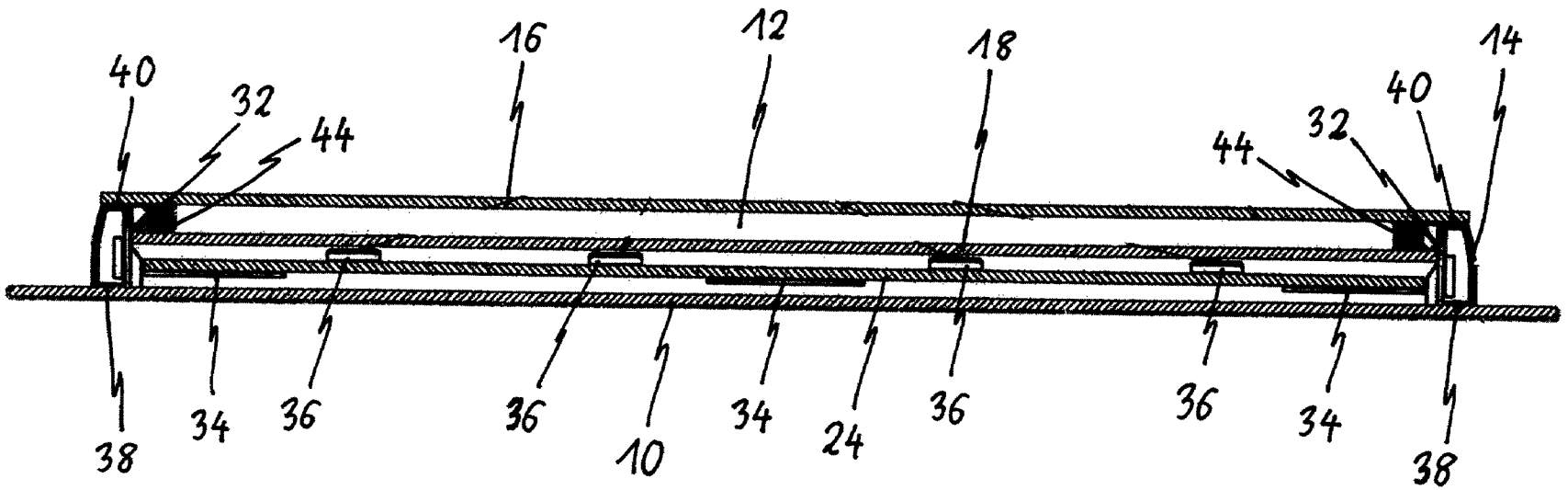

The present invention will be described in further detail with reference to the drawings, in which FIG. 1 illustrates a perspective view of an oven door according to a preferred embodiment of the present invention, FIG. 2 illustrates a further perspective view of the oven door according to the preferred embodiment of the present invention, FIG. 3 illustrates an exploded perspective view of the oven door according to the preferred embodiment of the present invention, FIG. 4 illustrates a sectional side view of the oven door according to the preferred embodiment of the present invention, and FIG. 5 illustrates a sectional top view of the oven door according to the preferred embodiment of the present invention.

FIG. 1 illustrates a perspective view of an oven door according to a preferred embodiment of the present invention.

The oven door includes an outer glass panel 10, a sandwich panel 12, a door frame 14 and a door handle 20. The outer glass panel 10 forms the outer side of the oven door. In a similar way, the sandwich panel 12 forms the inner side of the oven door. The door frame 14 is arranged between the outer glass panel 10 and the sandwich panel 12. The door handle 20 is attached at the outer side of the outer glass panel 10.

The outer glass panel 10 and the sandwich panel 12 are arranged in parallel. The large area of the outer glass panel 10 is bigger than the large area of the sandwich panel 12. The large area of the door frame 14 is substantially equal to the large area of the sandwich panel 12. The door frame 14 has a rectangular structure and comprises two elongated side parts 26 and two elongated transversal parts 28.

FIG. 2 illustrates a further perspective view of the oven door according to the preferred embodiment of the present invention.

In a mounted state, the oven door is pivoting around a horizontal swivel axis. In a closed state, the oven door is aligned vertically, while in an open state the oven door is aligned in a substantially horizontal position. In a closed state, the swivel axis is arranged parallel and close to the lower side of the oven door.

In this embodiment, a recess 22 is formed in the lower ends of the side parts 26 in each case. Said recess 22 is provided for receiving a hinge element of a door hinge. Thus, the recess 22 acts as a hinge support.

FIG. 3 illustrates an exploded perspective view of the oven door according to the preferred embodiment of the present invention.

The sandwich panel 12 includes a first inner glass panel 16 and a second inner glass panel 18. The first inner glass panel 16 and the second inner glass panel 18 are permanently glued together by a gluing strip 44. In this example, the large area of the first inner glass panel 16 corresponds with the outer large area of the door frame 14, while the large area of the second inner glass panel 18 is marginally smaller than the inner large area of the door frame 14. The first inner glass panel 16 is attached at the inner side of the door frame 14, wherein an inner sealing element 40 is arranged between the first inner glass panel 16 and the door frame 14. The second inner glass panel 18 is arranged inside the door frame 14.

In this example, the sandwich panel 12 includes two inner glass panels 16 and 18. In general, the sandwich panel 12 includes two or more inner glass panels 16 and 18.

Further, the oven door includes a central glass panel 24. Said central glass panel 24 is arranged between the outer glass panel 10 and the second inner glass panel 18. The central glass panel 24 is enclosed by the door frame 14.

Additionally, the door frame 14 includes two screw support projections 46. Preferably, the screw support projection 46 is formed as a rectangular sheet. In this example, the screw support projections 46 are arranged in neighboured inner corners of the door frame 14 and directed into the inner space of said door frame 14. Each screw support projection 46 includes one or more holes provided for receiving a screw 42. The screws 42 are provided for fixing the door handle 20. In particular, the screw support projections 46 are aligned at an inner side of the outer glass panel 10.

In this example, the door handle 20 is fixed by two screws 42 penetrating holes in the screw support projections 46 of the door frame 14 and in the outer glass panel 10 in each case. Alternatively, the door handle 20 may be glued at the outer side of the outer glass panel 10.

The door frame 14 is formed as a single-piece part. In particular, the door frame 14 is made of plastics. Preferably, the door frame 14 is closed, so that the inner space between the outer glass panel 10, the sandwich panel 12 and the door frame 14 is hermetically sealed.

The door frame 14 comprises a number of outer snap-in pin elements 30 arranged at the inner side of the upper transversal part 28. In this example, the upper transversal part 28 includes four outer snap-in pin elements 30. The outer snap-in pin elements 30 are directed to the outer side of the oven door. Moreover, the door frame 14 comprises a number of inner support projections 36 arranged at the inner side of the lower transversal part 28. The inner support projections 36 are not shown in FIG. 3. In this example, the lower transversal part 28 includes four inner support projections 36 arranged opposite to the four outer snap-in pin elements 30 in each case. The outer snap-in pin elements 30 and the inner support projections 36 support the inner side of the central glass panel 24.

Furthermore, the door frame 14 comprises a number of outer support projections 34. In this example, each transversal part 28 includes three outer support projections 34, while each side part 26 includes two outer support projections 34. The outer support projections 34 are directed into the inner space of the door frame 14. The outer support projections 34 support the outer side of the central glass panel 24.

The outer snap-in pin elements 30 and the inner support projections 36 on the one hand and the outer support projections 34 on the other hand are arranged at different levels. The central glass panel 24 is clamped between the outer snap-in pin elements 30 and the inner support projections 36 at its inner side and the outer support projections 34 at its outer side.

Additionally, the door frame 14 comprises a number of inner snap-in pin elements 32 arranged at the inner side of the side part 26. In this example, the side part 26 includes three inner snap-in pin element elements 32 in each case. The inner snap-in is pin elements 32 are provided for grasping the second inner glass panel 18 of the sandwich panel 12.

FIG. 4 illustrates a sectional side view of the oven door according to the preferred embodiment of the present invention.

The oven door includes the outer glass panel 10, the sandwich panel 12, the central glass panel 24, the door frame 14 and the door handle 20. The outer side of the oven door is formed by the outer side of the outer glass panel 10. In a similar way, the inner side of the oven door is formed by the inner side of the sandwich panel 12, i.e. the inner side of the first inner glass panel 16. The central glass panel 24 is arranged inside the door frame 14. The door handle 20 is attached at the outer side of the outer glass panel 10. The first inner glass panel 16 and the second inner glass panel 18 are permanently glued together by the gluing strip 44. The central glass panel 24 is clamped between the outer snap-in pin elements 30 and the inner support projections 36 at its inner side and the outer support projections 34 at its outer side.

FIG. 5 illustrates a sectional top view of the oven door according to the preferred embodiment of the present invention.

The oven door includes the outer glass panel 10, the sandwich panel 12, the central glass panel 24 and the door frame 14. The outer side of the oven door is formed by the outer side of the outer glass panel 10, while the inner side of the oven door is formed by the inner side of the sandwich panel 12, i.e. the inner side of the first inner glass panel 16. The central glass panel 24 is arranged inside the door frame 14. The central glass panel 24 is clamped between the outer snap-in pin elements 30 and the inner support projections 36 at its inner side and the outer support projections 34 at its outer side. The first inner glass panel 16 and the second inner glass panel 18 of the sandwich panel 12 are permanently glued together by the gluing strip 44. The second inner glass panel 18 of the sandwich panel 12 is grasped by the inner snap-in pin elements 32 arranged at the side parts 26 of the door frame 14.

The door frame 14 includes an outer groove at its outer side for receiving the outer sealing element 38. In a similar way, the door frame 14 includes an inner groove at its inner side for receiving the inner sealing element 40. The outer sealing element 38 and/or the inner sealing element 40 may be realized by a gluing strip, for example by a silicone gluing strip. Further, the outer sealing element 38 and/or the inner sealing element 40 may be realized by a gasket.

The door, in particular oven door, according to the present invention is realized by low complexity, low costs and an easy manufacturing process. The door frame 14 forms the central part of the door, wherein the glass panels 10, 12, 16, 18 and 24 are directly fixed at said door frame 14. At least one of the glass panels 10, 12, 16, 18 and 24 may be directly glued onto the door frame 14. The door of the present invention is suitable for an automatic manufacturing process.

Optionally, the door frame 14 may include one or more additional components for aesthetical purposes. Said components may be integrated parts of the door frame 14. For example, the components for aesthetical purposes are integrated into the door frame 14 by a two-component moulding process.

Although illustrative embodiments of the present invention have been described herein with reference to the accompanying drawings, it is to be understood that the present invention is not limited to those precise embodiments, and that various other changes and modifications may be affected therein by one skilled in the art without departing from the scope or spirit of the invention. All such changes and modifications are intended to be included within the scope of the invention as defined by the appended claims.

List of Reference Numerals

10 outer glass panel
12 sandwich panel
14 door frame
16 first inner glass panel
18 second inner glass panel
20 door handle
22 recess
24 central glass panel
26 side part
28 transversal part
30 outer snap-in pin element
32 inner snap-in pin element
34 outer support projection
36 inner support projection
38 outer sealing element
40 inner sealing element
42 screw
44 gluing strip
46 screw support projection

The invention claimed is:

1. A door for a domestic appliance, wherein said door comprises:

a door frame formed as a closed rectangular frame, at least one first glass panel attached or attachable at a first side of the door frame, at least one second glass panel attached or attachable at a second side of the door frame opposite the first side of the door frame, at least one first sealing element arranged or arrangeable between the first glass panel and the first side of the door frame, and at least one second sealing element arranged or arrangeable between the second glass panel and the second side of the door frame, at least one inner space inside the door frame and between the first glass panel and the second glass panel, a third glass panel arranged or arrangeable in said at least one inner space, and a fourth glass panel attached or attachable at an inner periphery of the door frame within said inner space, wherein the fourth glass panel is arranged between the first glass panel and the third glass panel, wherein a large area side of the first glass panel is bigger than a large area side of the door frame, the large area side of the first glass panel is bigger than a large area side of the second glass panel, said at least one inner space inside the door frame is hermetically closed, said second glass panel and said third glass panel are permanently connected to each other, and said door frame includes at least one snap-pin element for grasping the third glass panel.

2. The door according to claim 1, wherein the door frame is made of plastics and/or is formed as a single-piece part.

3. The door according to claim 1, wherein the door frame includes at least one support projection for supporting a side of the fourth glass panel, wherein the support projection is directed into the inner space of the door frame.

4. The door according to claim 1, wherein the door frame includes at least one further snap-in pin element and at least one further support projection for supporting the fourth glass panel, wherein the further snap-in pin element and the further support projection are directed into the inner space of the door frame.

5. The door according to claim 1, wherein the door frame includes at least one first groove for receiving the first sealing element and at least one second groove for receiving the second sealing element.

6. The door according to claim 1, wherein at least one of the first sealing element and the second sealing element is a gluing strip.

7. The door according to claim 6, said gluing strip comprising a silicone gluing strip.

8. The door according to claim 1, wherein at least one of the first sealing element and the second sealing element is a gasket.

9. The door according to claim 1, wherein at least one of the glass panels is molded at the door frame.

10. The door according to claim 1, wherein the door frame includes two side parts and at least two transversal parts, wherein each side part comprises at its lower end a recess for receiving a hinge element of a door hinge.

11. The door according to claim 1, wherein the door frame includes at least one screw support projection with at least one hole for receiving a screw, wherein said screw support projection is directed into the inner space of the door frame, and wherein the at least one screw is provided for fixing a door handle.

12. A domestic appliance comprising the door according to claim 1.

13. The domestic appliance of claim 12, said appliance being a cooking oven.

14. The door according to claim 1, wherein said second glass panel and said third glass panel are connected by a gluing strip.

* * * * *